United States Patent [19]

Omachen et al.

[11] Patent Number: 4,693,199

[45] Date of Patent: Sep. 15, 1987

[54] RELEASE MEANS FOR SAILBOARD FOOTSTRAPS

[76] Inventors: Ludwig Omachen, 6 Bells Boulevard, Jan Juc, 3228, Victoria; Stephen Janson, 38 Sheepwash Road, Barwon Heads, 3227, Victoria, both of Australia

[21] Appl. No.: 804,342

[22] Filed: Dec. 2, 1985

[30] Foreign Application Priority Data

Nov. 30, 1984 [AU] Australia ..... PG8383

[51] Int. Cl.[4] ..... B63H 9/04

[52] U.S. Cl. ..... 114/39; 441/70; 441/75; 24/602; 24/653

[58] Field of Search ..... 114/39.2, 247; 441/75; 24/115 F, 602, 653; 440/74, 70, 69

[56] References Cited

U.S. PATENT DOCUMENTS 3,675,282 7/1972 Summers et al. ..... 24/602

3,704,633 12/1972 Iverson ..... 24/602

FOREIGN PATENT DOCUMENTS 172 10/1981 PCT Int'l Appl. ..... 441/75

*Primary Examiner*—Jeffrey V. Nase

*Assistant Examiner*—Thomas J. Brahan

*Attorney, Agent, or Firm*—Andrus, Sceales, Starke & Sawall

[57] ABSTRACT

A release arrangement for a sailboard footstrap (10) which has a female member (22) and a male member (74). The female member (22) is composed of two identical components (38,40) which locate together by means of pins (52,152) locating in apertures (154,54). Chamfered apertures (48,148) in resilient arm portions (46,146) of the female member (22) are adapted to receive and retain frusto-conical bosses (94,90) on the male member (74). The bosses (94,90) are located on a portion (82) of the male member (74), the sides (84,86) of which abut pins (52,152) when relative rotation of the members (22,74) about the engaged bosses and apertures (94,48; 90,148) occurs, the abutment serving to lever the bosses (94,90) from the apertures (48,148) at a predetermined magnitude of force exerted to cause rotation. The male (74) and female (22) members may also disengage at other predetermined magnitudes of forces exerted upon the arrangement in other directions.

15 Claims, 9 Drawing Figures

RELEASE MEANS FOR SAILBOARD FOOTSTRAPS

This invention relates to release means for a safety strap or the like, and is particularly applicable to sailboards and, more specifically, to the type of sailboards known as "wavejumpers".

Wavejumper sailboards are generally provided with footstraps in the form of loops, the ends of which are secured to the board in an area aft of the mast coupling, close to the tail of the board. The footstraps are normally located on the longitudinal axis of the board, so that a rider may stand on either side of the sail, but on some boards there may be side straps. Footstraps are invaluable in the wavejumper type of sailboard, as the sailing of such a board often involves manoeuvres in which the board is out of the water at various steep angles, and the rider's feet would often lose contact with the board if they were not located in footstraps.

One disadvantage of conventional footstraps is that they do not include release mechanisms. There are often occasions when a sailboard rider can be injured by a sailboarding mishap, during which he has not been able to extract his feet from footstraps.

U.S. Pat. No. 3,675,282 to Summers et al describes a mechanical fuse for linking two members together such that separation forces exceeding a particular value cause the male and female members constituting the fuse to separate.

The female member includes spring means having a latch supported therein, which, latch co-operates with features on the male member. When the separation force exceeds the particular value the spring means is deformed, the engagement between the latch and the male member is broken, and the members separate.

Such an arrangement is described in its application in the packaging of emergency escape slides in aircraft, and is not suitable for use as a release device for sailboards and the like. The arrangement of U.S. Pat. No. 3,675,282 is also too complex in construction to be useful in a sailboarding context.

U.S. Pat. No. 3,704,633 discloses a keeper component fabricated from a plurality of juxtaposed metal plate members. The members have recesses therein for receiving a spring-loaded ball which is adapted to engage an aperture in a removable latch member. When a force above a particular value is exerted upon the latch, detent action between the ball and the latch member aperture is broken, and the latch is released.

The arrangement of U.S. Pat. No. 3,704,633 is described in its application to a release assembly for a dog leash, and is unsuitable for use in a sailboarding context.

It is an object of this invention to provide an improved, effective release means for a sailboard footstrap.

It is also an object of this invention to provide a release mechanism that has four distinct release modes, which may operate independently or in combination, depending on the magnitude and direction of the forces applied to the release mechanism.

The invention provides a release arrangement for a sailboard footstrap including a first member and a second member, said members being provided with means which enable them to be engaged and to remain engaged until a particular release mode operates in response to a predetermined force action in a particular manner upon the engaged members.

An embodiment of the invention will be described in detail hereinafter, with reference to the accompanying drawings, in which:

FIG. 1 shows a typical footstrap arrangement 10, for attachment to a sailboard (not shown). Normally there can be up to five footstraps on a wavejumper sailboard, all of which may take the form of the footstrap 10.

Figure 1:
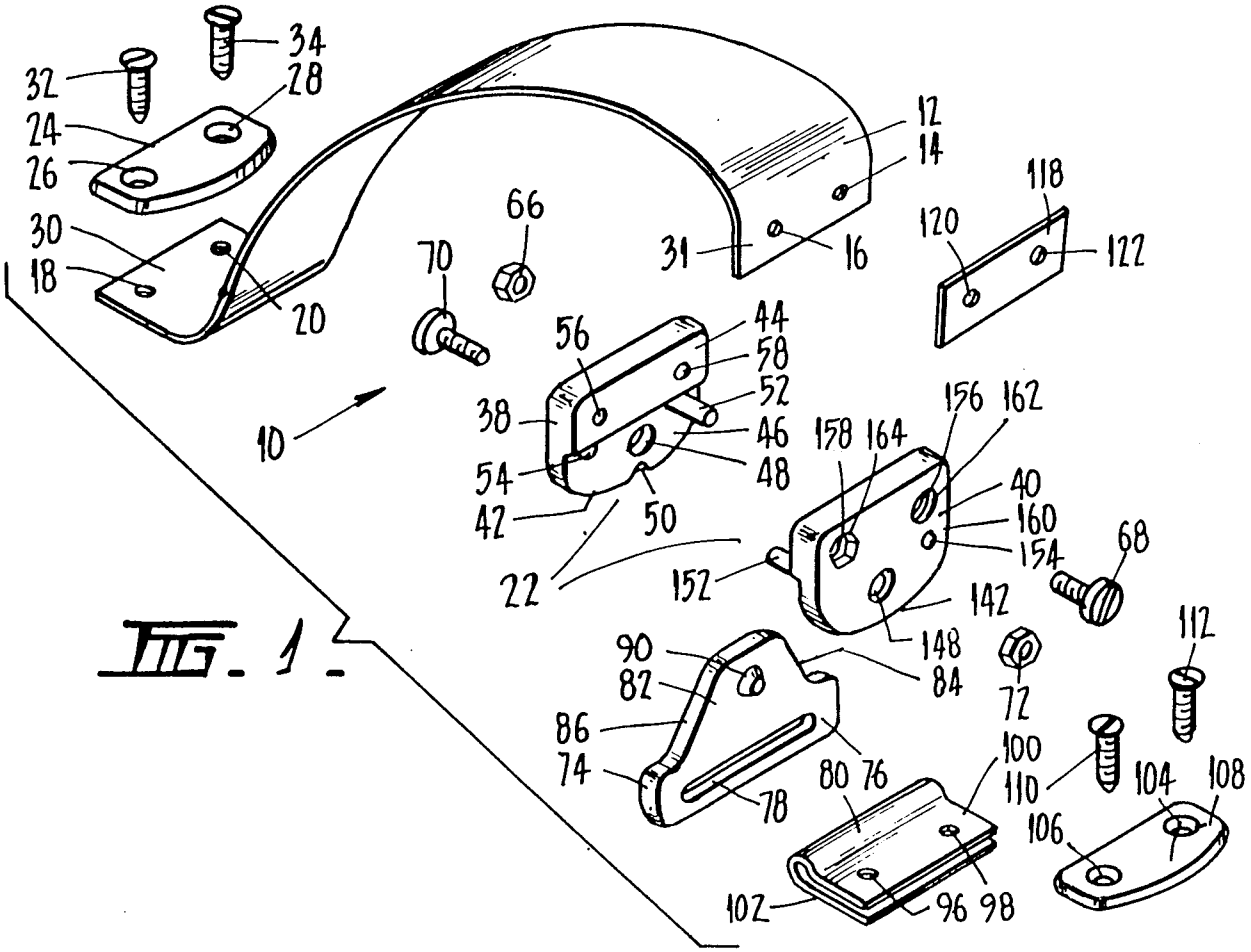
FIG. 1 is an exploded perspective view of a footstrap incorporating one embodiment of release means according to this invention.

The footstrap 10 includes a strap 12, preferably formed from polypropylene sheet material 13, with or without a portion of seat belt webbing 15 attached to its lower surface. Strap 12 has apertures 14,16, and 18,20 for attachment to the sailboard and female release means member 22 respectively.

A clamping plate 24 with apertures 26,28 is used to attach first end 30 of strap 12 to a sailboard upper surface. The plate 24 is preferably moulded from nylon or acetal plastics material. Screws 32,34, preferably stainless steel self-tapping screws, pass through apertures 24,18 and 28,20 respectively into plastic plugs (one of which is denoted in FIG. 7 by reference numeral 36) glued or otherwise secured into the sailboard core.

Figure 2:
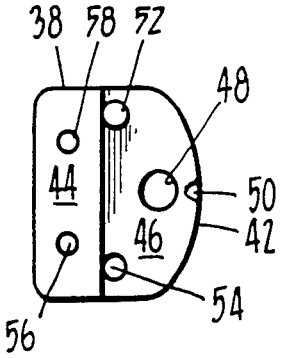
FIG. 2 is a plan view from one side of a release means female member component.
Figure 3:
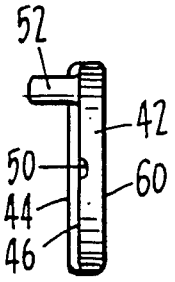
FIG. 3 is an end elevation from the right of FIG. 2, of the component of FIG. 2.
Figure 4:
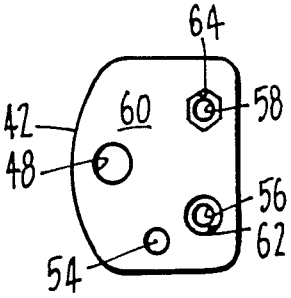
FIG. 4 is a plan view from the other side of the component of FIG. 2.

Female release means member 22, consists of two identical components 38,40, the former of which is also shown in detail in FIGS. 2, 3 and 4. Components 38,40 are preferably formed from hard grade injection moulded urethane elastomer. The component 38 has a generally rectangular shape, with one curved end 42. The inner face 44 has a recessed portion 46, which has an aperture 48 therein, with a chamfered portion 49 adjacent to recessed portion 46. Alternatively, the aperture may be frusto-conical in configuration. Between aperture 48 and curved end 42 is a notch 50. A locating pin 52 extends from one side of recessed portion 46, and there is a locating aperture 54 on the other side of the portion. Connection apertures 56,58 extend from outer face 50 to inner face 44. Aperture 56 has a chamfer 62, and aperture 58 has a recessed hexagonal portion 64 to accommodate a hexagonal nut 66, which in the assembled member 22 engages with bolt 68. Bolt 70 extends through aperture 56 to engage with hexagonal nut 72.

Component 40 has features 142, 144, 146, 148, 149, 150, 152, 154, 156, 158, 160, 162 and 164 inclusive (most of which are shown in FIG. 1) identical respectively to the features denoted by reference numerals 42, 44, 46, 48, 49, 50, 52, 54, 56, 58, 60, 62 and 64 in relation to component 38.

A thin packing piece 118 (or a plurality of such pieces) may be used to increase the distance between components 38,40 when they are assembled into female member 22 and attached to second end 31 of strap 12. Packing piece 118 has apertures 120,122 therein.

To assemble female member 22 in place on second end 31, components 38 and 48 are advanced towards each other, until pin 52 enters aperture 154, and pin 152 enters aperture 54. If a packing piece 118 is used, it is placed between surfaces 44 and 144, as is end 31 of strap 12. Apertures 56, 16, 120 and 158 are then placed in register, bolt or screw 70 is inserted therein, and is tightened on nut 72 which is located in recessed portion 164. Apertures 58, 14, 122 and 156 are also in register, and bolt or screw 68 is inserted therein, to be tightened on nut 66 located in recessed portion 64.

Figure 5:
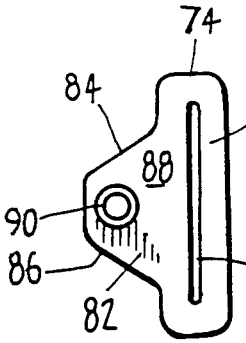
FIG. 5 is a plan view of a release means male member.
Figure 6:
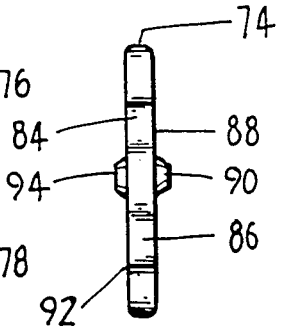
FIG. 6 is an end elevation from the left in FIG. 5 of the member of FIG. 5.

Male member 74 also shown in FIGS. 5 and 6, has a first portion 76 in which a narrow slot 78 is provided, for the attachment of a loop 80 of seat belt webbing or the like. A second portion 82 extends from the first portion, with tapering sides 84,86. On one surface 88 of second portion 82 is a frusto-conical boss 90, and on the other surface 92 of second portion 82 is a registering frusto-conical boss 94. Component 74 is preferably injection moulded from an acetal plastic.

Loop 80 has apertures 96,98 in a first, upper portion 100, and registering apertures (not shown) in a lower portion 102. After upper portion 100 is passed through slot 78 in member 74, the loop 80 is clamped to the sailboard by a clamping plate 104 which is identical to previously described clamping plate 24. Plate 104 has apertures 106,108, which register with apertures 96,100 and through which screws 110,112 (preferably stainless steel self-tapping screws) pass into plastic plugs (one of which 114 is shown in FIG. 7) attached to the sailboard core material 116.

Figure 8:
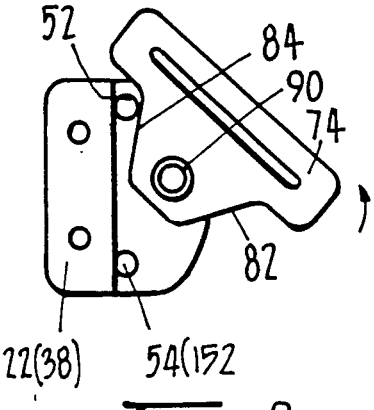
FIG. 8 is a plan view of release means components relatively rotated to one position.
Figure 9:
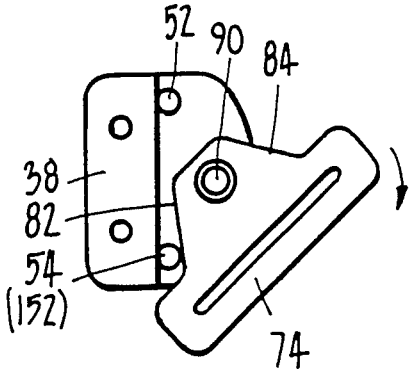
FIG. 9 is a plan view of release means components relatively rotated to another position.

To connect member 22,74, male member 74 is pushed into the aperture between portions 46,146 of female member 22. Bosses 90,94 are pushed into notches 150,50 respectively, which aids in spreading portions 46,146 apart, thereby easing the male member 74 into the female member 22. The portions 46,146 at least should be formed from a slightly resilient material, such as that previously mentioned. With the portions 46,146 deformed outwardly, the male member can seat in the aperture between the portions 46,146, with bosses 90,94 being captive in apertures 148,48 respectively, portions 46,146 resuming their normal positions. As shown in FIGS. 8 and 9, there is enough spacing provided between walls 82,84 of member 74 element and pins 52,152 of member 22 element to provide an ability for the arrangement to adapt to the angle of the rider's foot. Thus, there is an ability for the members 22,74 to rotate relatively, to a limited degree, about the axis of the engaged bosses 90, 94 and apertures 148,48.

Figure 7:
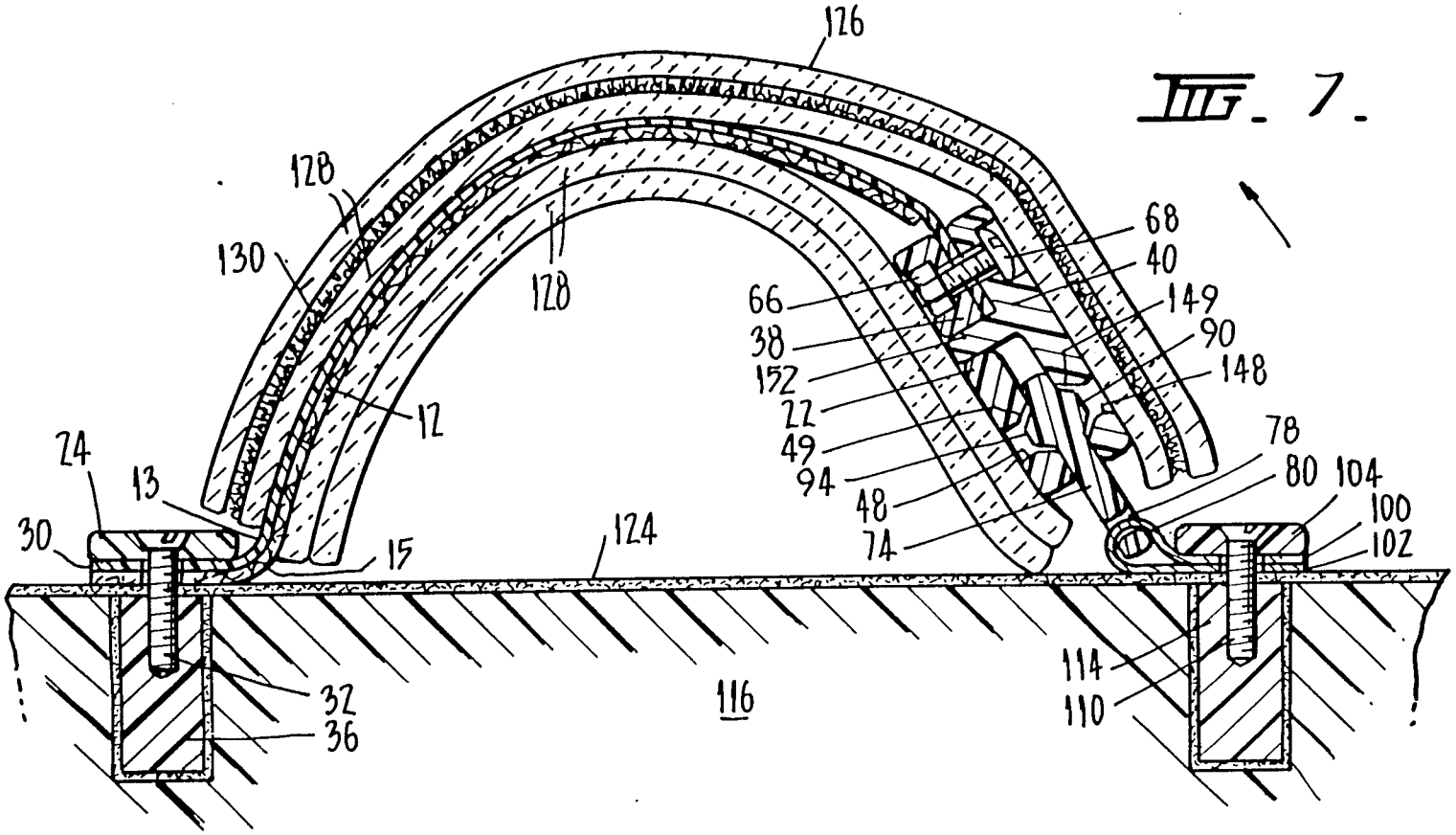
FIG. 7 is a cross-sectional view through an assembled footstrap incorporating the release means embodiment.

FIG. 7 shows a preferred footstrap mounting arrangement 10 in section, with the various components of FIGS. 1 to 6 assembled into an "in-use" situation. The sailboard skin, typically plastic or fibreglass cloth and polyester resin, is denoted by 124.

A typical cover 126 is also shown. The cover 126 consists of a neoprene sheet portion 128 wrapped around strap arrangement 10 and secured by a portion 130 of Velcro (Registered Trade Mark) material.

Under normal boardriding circumstances, the forces on the footstrap and buckle elements would not be sufficient to require or cause the release means to operate. However, there are four modes of release which may operate in the appropriate circumstances.

Firstly, there is the release mode which operates when forces along the longitudinal axis of members 22,74 (shown by the arrow in FIG. 7) exceed a predetermined value. This is the direction in which the greatest force must be exerted on the connection of members 22,74 to disengage them.

As has been described, bosses 90,94 are frusto-conical, and the edges of apertures 48,148 are chamfered (49,149). With sufficient force in the direction of the arrow, the bosses 90,94 will climb out of apertures 48,148, and will spread components 38,40 of member 22 apart, enabling male member 74 to withdraw female member 22. This first release moment would operate for example, when a sailboard/wavejumper became airborne, and thereafter entered the water tail first.

FIGS. 8 and 9 show the second release mode. This second mode operates when a relatively rotating force is applied to members 22,74, for example when the rider falls forward or backward.

In this release mode, wall 84 of member 74 co-operates with pin 52, (FIG. 8) or wall 82 co-operates with pin 152 in lever-type actions to lever bosses 90,94 from sockets 48,148.

A third release mode operates where there is relative twisting of elements 22,74 that is, relative rotation about their common longitudinal axis. This may occur when a rider's foot twists in the strap 12. The relative twisting forces recessed portions 46,146 apart, allowing bosses 90,94 to leave apertures 48,148 thus allowing male member 74 to leave female member 22. The force at which this mode operates can be varied, as stated hereinbefore, by the inclusion or omission of one or more packing pieces(s) 118.

A fourth release mode caters for the situation when there is excessive lateral pressure on the strap arrangement 10. This may occur when the rider's foot slides sideways along the longitudinal axis of the sailboard, usually in a forward direction, in FIG. 7 from right to left. This usually occurs after the sailboard has become airborne; upon landing it enters the water with its nose pointing downwards at an excessively steep angle. As a result the board comes to a sudden stop, causing the rider to move forward relative thereto.

With the motion of the foot in the direction indicated, the release means "springs" open, under the influence of the force which is in the indicated direction.

In each of the four release modes, there is a separate varying predetermined force at which each mode will operate. The buckle's four modes cater for all types of sailboarding mishaps, and ensure that a rider's feet cannot be trapped in footstraps if a mishap occurs. Some exemplary release mode operational weights may be 50 kg to 100 kg for the first mode, and 5.44 kg for mode two.

In general, it is observed that adjustment for various foot sizes may be made by adjusting the length of the strap 12, by providing a number of mounting holes therein, by a Velcro (Registered Trade Mark) type connection, or in any other manner.

What we claim is:

1. A release arrangement for a sailboard footstrap having a plurality of release modes; said arrangement including male and female members adapted to be connected to a footstrap portion or the sailboard; said male member being adapted for insertion into a space between flexible portions of said female member; said members being provided with engagement means which retain said members in engagement, after said insertion, against the influence of forces having values below predetermined values; said engagement means including at least one boss on said male member or on a said portion of said female member engageable in at least one recess in a said portion of said female member or in said male member; said male and female members being permitted limited relative rotational movement about an axis of said engaged boss and recess under the influence of a rotational force; said male and female members having elements co-operating to lever said boss from said recess by flexing at least one of said portions when said relative rotation exceeds the limit of said limited rotational movement under the influence of a rotational force having a first predetermined value, to provide one of said release modes.

2. A release arrangement according to claim 1, wherein said boss and recess are so formed and the flexibility of said portions is such that a second release mode operates when a force exerted in a direction along the footstrap exceeds a second predetermined value.

3. A release arrangement according to claim 2, wherein said boss and recess are so formed and the flexibility of said portions is such that a third release mode operates when a force acting generally parallel to said axis and applied to one of said members with a predetermined value causes said portions to flex and the disengagement of said release arrangement.

4. A release arrangement according to claim 2, wherein said boss and recess are so formed and the flexibility of said portions is such that a third release mode operates when a twisting force exceeding a third predetermined value acts to twist one of said members relative to the other.

5. A release arrangement according to claim 4, wherein said boss and recess are so formed and the flexibility of said portions is such that a fourth release mode operates when a force acting generally parallel to said axis and applied to one of said members with a predetermined value causes said portions to flex and the disengagement of said release arrangement.

6. A release arrangement according to claim 1, wherein said boss and recess are so formed and the flexibility of said portions is such that a second release mode operates when a twisting force exceeding a second predetermined value acts to twist one of said members relative to the other.

7. A release arrangement according to claim 6, wherein said boss and recess are so formed and the flexibility of said portions is such that a third release mode operates when a force acting generally parallel to said axis and applied to one of said members with a predetermined value causes said portions to flex and the disengagement of said release arrangement.

8. A release arrangement according to claim 1, wherein said boss and recess are so formed and the flexibility of said portions is such that a second release mode operates when a force acting generally parallel to said axis and applied to one of said members with a predetermined value causes said portions to flex and the disengagement of said release arrangement.

9. A release arrangement according to claim 1, wherein said boss is provided on said male member, and said recess is provided on said female member.

10. A release arrangement according to claim 1, wherein said female member is composed of two identical components connected in a generally opposing manner to provide said spaced flexible portions.

11. A release arrangement according to claim 10, wherein each said component includes a pin which seats in an aperture or recess in the other component to locate said components relative to each other, said pins constituting said elements levering said boss from said recess.

12. A release arrangement according to claim 10, wherein the distance between said components may be varied by inserting packing pieces therebetween, in order to vary the force at which a release mode may operate.

13. A release arrangement according to claim 1, wherein said boss is frusto-conical in shape.

14. A release arrangement according to claim 1, wherein said recess is chamfered.

15. A release arrangement for a sailboard footstrap, including male and female members adapted to be connected to a footstrap portion or the sailboard; said female member including two generally parallel flexible portions defining a space; said male member being generally planar and adapted for insertion into said space in said female member; said members being provided with engagement means which normally retain said members in engagement after said insertion, said engagement means comprising a generally frusto-conical boss on each major face of said male member and a mating recess in the inner face of each portion of said female member; said male and female member being permitted limited relative rotational movement about the axis of said engaged bosses and recesses, said male member having lateral surfaces capable of co-operating with lateral surfaces of said female member extending between said portions when the limit of said limited rotational movement is reached under the influence of a rotational force exceeding a predetermined value to lever said bosses from said recesses by flexing said portions, thereby disengaging said members.

* * * * *